United States Patent [19]

Seamon

[11] 4,073,175

[45] Feb. 14, 1978

[54] DRUM LIFTING METHOD AND DEVICE

[76] Inventor: Paul Seamon, 6191 Anthony Ave., Garden Grove, Calif. 92645

[21] Appl. No.: 755,595

[22] Filed: Dec. 30, 1976

[51] Int. Cl.[2] ..... B21D 31/02

[52] U.S. Cl. ..... 72/325; 214/620; 294/68; 294/78 R

[58] Field of Search ..... 72/325; 30/450; 403/244; 254/133 R, 187.8; 220/94 A; 214/620; 294/27 R, 27 H, 68, 78 R

[56] References Cited

U.S. PATENT DOCUMENTS

| | | | |
|---|---|---|---|
| 1,030,845 | 6/1912 | Kauffman | 220/94 A |
| 2,696,317 | 12/1954 | Toffolon | 214/620 |

FOREIGN PATENT DOCUMENTS

| | | | |
|---|---|---|---|
| 734,121 | 7/1955 | United Kingdom | 30/450 |

*Primary Examiner*—Lowell A. Larson

[57] ABSTRACT

An improved method and apparatus for lifting a metal drum by the use of a fork lift truck. The method utilizes the steps of forming at least two openings at the bottom edge of the upper lid of the drum to be lifted. The opening is formed with a bent-over portion which forms a cushion for a hook or other device to be inserted. At least two hooks are next inserted in the openings and the hooks are affixed to the fork of a fork lift truck which, when raised, lifts the drum.

8 Claims, 2 Drawing Figures

DRUM LIFTING METHOD AND DEVICE

BACKGROUND OF THE DISCLOSURE

Open top drums are commonly used in many industries for the storing and moving of manufactured parts metal cuttings to be salvaged and the like. Such drums are typically placed near the point which the contents will be used or being deposited. When desired, the drum is then moved to a second location or, in the case of finished goods to a truck for later transport.

While fork lift trucks are ideally designed for lifting drums which have been placed on a wooden pallet they are not well equipped to move open top drums which are resting directly on the floor. For this reason, many approaches such as tipping the drum and balancing it on a fork are employed with a substantial hazard created if the drum is not centrally positioned. Various clamps have been designed for attachment to open top drums but such clamps are not only expensive but are time consuming to use.

Frequently the forks of a fork lift truck are positioned so that they are exactly the width of a drum away from each other. The two forks are then straddled under the upper lid of the drum for lifting. This procedure although widely used has several substantial drawbacks. First, unless the forks are carefully aligned to straddle the drum one of the forks can easily penetrate the drum thus damaging it. Furthermore if the drum is somewhat out of round it can slip out from between the two forks. With the increased desire to reduce overhead, methods for speeding the movement of materials are continually sought.

SUMMARY OF THE INVENTION

The present invention is for a method and apparatus for lifting metal drums utilizing one or both of the forks of a fork lift truck. The first step in the method involves forming at least two openings in the side of the drum at the bottom edge of the upper lid of the drum. Each of these openings has a reinforcing portion formed from the drum itself which helps cushion or support the hook which is then inserted in each opening. The hooks are supported by chain means which may be affixed to a bracket which in turn is placed over the fork of the fork lift truck. A tool for cutting an opening having a lift-hook support has a lever arm and a cutting arm. The cutting arm preferably has two sharpened edges which terminate in a point. The cutting member has a lever arm which permits it to be easily used to cut into the side of the drum. The cut portion of the drum is bent around and positioned over the lid and helps to cushion and support the hook.

DESCRIPTION OF THE PREFERRED EMBODIMENTS

Figures 1, 2, 3, 4, 5, 6, 7:
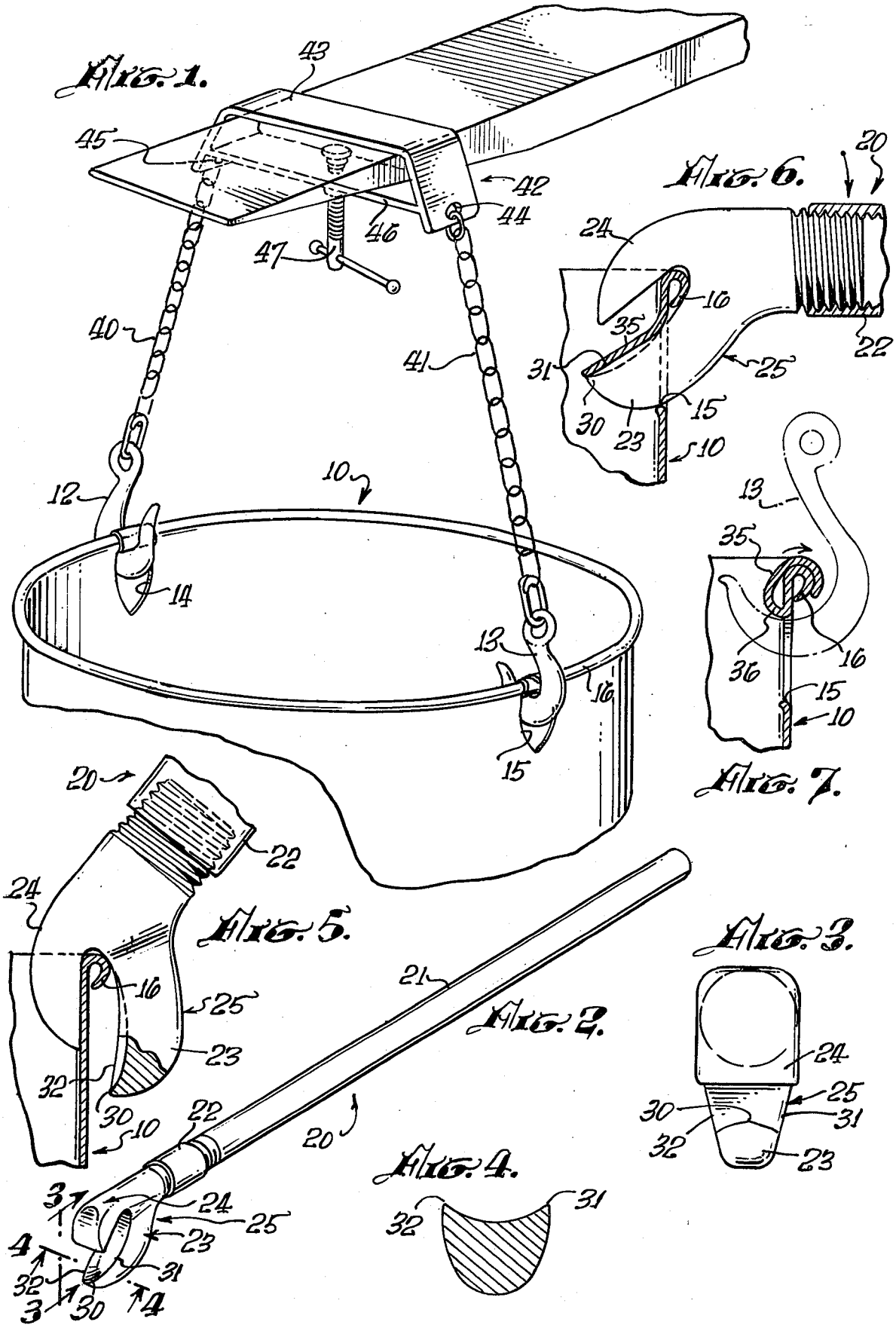
FIG. 1 is a perspective view partially cutaway showing a drum supported by a pair of hooks, chains and a bracket which in turn are supported on a fork of a fork lift truck.
FIG. 2 is a perspective view of the cutting member useful in forming the openings in a drum such as that shown in FIG. 1.
FIG. 3 is an enlarged end view taken along line 3—3 of FIG. 2.
FIG. 4 is an enlarged cross-sectional view taken along line 4—4 of FIG. 2.
FIG. 5 is a side view partially cutaway showing the cutting member positioned over the upper lid of a drum.
FIG. 6 shows the cutting member and drum of FIG. 5 moved to a partially cut position.
FIG. 7 shows a cross-sectional view of the drum of FIG. 6 with an opening formed therein.

A metal drum 10 is shown in FIG. 1 supported by a hook and chain apparatus which in turn is held by the fork 11 of a fork lift truck not shown. Drum 10 is of a common open top drum variety which has a curled over upper lid shown in cross-sectional view in FIG. 5. Such drums are typically about 54 gallons in capacity and, when filled with oil or other organic liquids typically weigh approximately 500 pounds. Open top drums are often formed by cutting the lid from a close top drum and the present invention is equally useful with drums of this type.

As shown in FIG. 1, drum 10 is supported by a pair of hooks 12 and 13 which are inserted in openings 14 and 15 which are formed under the upper lip 16 of drum 10.

The openings such as openings 14 and 15 are formed by the cutting tool shown in perspective view in FIG. 2. Because of economy of manufacture and packaging the cutting tool 20 has a threaded 1 inch pipe 21 screwed into coupling 22 which in turn is threaded into the cutting portion of cutting tool 20. The cutting portion has a cutting arm 23 and a lever arm 24 the portion of the cutting tool which is threaded onto coupling 22 will be referred to generally as cutting head 25.

Cutting head 25 is shown in an enlarged end view in FIG. 3. Lever arm 24 is shown over cutting arm 23 and the operation of cutting head 25 is shown best in FIGS. 5 and 6. In FIG. 5 the lever arm 24 is inserted over lip 16 of drum 10. The cutting arm 23 has a point 30 and a pair of cutting edges 31 and 32. An indentation exists between cutting edges 31 and 32 as shown best in FIG. 4. This facilitates the sharpening of edges 31 and 32.

Cutting head 25 should be fabricated from a material of relatively high strength and hardness. It has been found that hardened cast steel will retain its cutting edges for a substantial length of time and is the material of preference for fabrication of the cutting head. By use of lever arm 21 cutting arm 23 is moved inwardly and upwardly with respect to drum 10 as shown best in FIG. 6. A flap of material 35 is formed and continued downward movement of the cutting head will cause the flap 35 to extend upwardly and outwardly of the drum 10. This flap is preferably hammered or otherwise bent around the lip 16 in a manner shown in crosssectional view in FIG. 7. The lower edge of flap 35 is indicated in FIG. 7 by reference character 36. This lower edge 36 forms an important part of the present invention and is believed responsible for the ability of the device of the present invention to lift drums containing as much as 500 pounds without destroying the opening.

The length of arm 21 is not critical but lengths of approximately 20 inches of 1 inch pipe have been sufficient to make it easy to operate the cutting tool.

Hooks such as hooks 12 and 13 may then be inserted in the opening 15 and the lifting surface of hook 13 rests against and is supported by lower edge 36 of flap 35. This is believed to distribute the weight over a relatively wide portion of lip 16 and help prevent a further tearing of opening 15.

While it has been known to chisel holes in the upper portion of drums such holes are far more fragile because they do not contain a flap 35 which serves as a supporting member to a lifting hook. Furthermore, a chisel opening almost invariably has sharp points or edges which form safety hazards to those using the drum.

Hooks 12 and 13 are affixed by chains 40 and 41 to bracket 42. Bracket 42 has an upper member 43 which is placed over fork 11 of the fork lift truck. Upper member 43 is bent downwardly and has an opening 44 to which chain 41 is attached. A second opening 45 is shown in phantom lines to which chain 40 is affixed. A cross brace 46 has a threaded opening through which a tightening screw 47 is placed. This allows the bracket 42 to be securely affixed to fork 11.

Hooks having a lift rating of 700 lbs. each have been satifactory for use with the present invention. Each chain or cable should have a lifting strength of about 700 lbs. to assure an appropriate safety factor for the lifting capacity of the device of the present invention. One-quarter inch by 2 inch wide steel bars provides sufficient strength for lifting a drum having a gross weight of 500 lbs.

If the chain length is approximately one foot one inch in length a standard 54 fallon steel drum may be lifted to the height of a stake-bed truck by all known conventional fork lift trucks.

The cutting head of the present invention should form an opening of about 1 inch in width at the upper end, although widths of between ¾ and 2 inches may alternatively be used. It has been found that a lever arm about 1¼ inch in width and 1¼ inch in length has been satisfactory for use in combination with a cutting arm of slightly less than 1 inch in width and approximately 2 inches in length. The other end of the tool is preferably threaded so that the tool may be used with standard threaded pipe. It has been found that 1 inch pipe is satisfactory although smaller or larger pipe sizes may be used according to the thickness and type of drums being cut. The opening between the lever arm and the cutting arm must be sufficient to permit the standard lip of an open top drum to be inserted therein. An opening somewhat in excess of ½ of an inch and preferably about ⅝ of an inch has been found satisfactory. Such an opening is also useful for forming an opening in close top drums from which the head has been removed.

In the event of overloading or where one of the openings tears through the rim of the drum, a second pair of openings can be easily formed. Whereas the present invention has been described using two openings, three, four or more openings may alternatively be used.

The present embodiments of this invention are thus to be considered in all respects as illustrative and not restrictive, the scope of the invention being indicated by the appended claims rather than by the foregoing description. All changes which come within the meaning and range of equivalency of the claims therefore are intended to be embraced therein.

I claim:

1. An improved method for lifting metal drums of about fifty four gallon capacity with the fork of a fork lift truck of the type wherein a drum attachment fixture is affixed to the lifting fork of a fork lift truck, wherein the improvement comprises:

forming at least two reinforced openings in the side of the drum at the bottom edge of the upper lid of the drum, each of said openings being formed by a cutting member having a lever arm and a cutting arm, said lever arm fitting over the upper lid of the drum to be lifted and said cutting arm having an indented portion having two sharpened edges terminating in a sharpened point whereby a V-shaped portion of said drum is cut and bent to form a generally V-shaped opening in the side of said drum, the wider end of the V-shaped opening having a bentover portion which forms a cushion or support for hook means; and inserting at least two hook means in said openings, said hook means being supported by the fork of a fork lift truck by chain means.

2. The method of claim 1 wherein two openings are formed.

3. The method of claim 1 wherein said cutting member is threaded on one end for insertion onto a threaded iron pipe.

4. The method of claim 1 wherein said hook means are supported by a pair of chain means affixed to a bracket which, in turn, is affixed to the fork of a fork lift truck.

5. The device of claim 4 wherein said bracket has an upper bar adapted to fit over a fork and having means to affix chain means to the lower extremities thereof.

6. The method of claim 5 wherein said bar has a cross-brace affixed thereto, said cross-brace adapted to fit under the fork.

7. The method of claim 6 wherein said cross-brace has tightening means threaded therethrough.

8. The method of claim 1 wherein said cutting arm is about 2 inches in length and 1 inch in width.

* * * * *